US005149265A

United States Patent [19]

Finke

[11] Patent Number: 5,149,265

[45] Date of Patent: Sep. 22, 1992

[54] METHOD FOR FIRING DIRECT-FIRED BURNER

[75] Inventor: Harry P. Finke, Pittsburgh, Pa.

[73] Assignee: Bloom Engineering Company, Inc., Pittsburgh, Pa.

[21] Appl. No.: 708,185

[22] Filed: May 31, 1991

[51] Int. Cl.[5] ..... F27D 7/00

[52] U.S. Cl. ..... 432/24; 431/62; 236/78 B

[58] Field of Search ..... 236/15 BB, 78 B; 432/24, 36; 431/62, 75

[56] References Cited

U.S. PATENT DOCUMENTS

| | | | |
|---|---|---|---|
| 3,112,919 | 12/1963 | Gunow | 236/15 BB |
| 4,120,639 | 10/1978 | Thekdi et al. | 431/158 |
| 4,309,165 | 1/1982 | McElroy | 431/8 |
| 4,475,885 | 10/1984 | Finke | 431/182 |
| 4,834,644 | 5/1989 | Snow | 432/24 X |

FOREIGN PATENT DOCUMENTS

| | | | |
|---|---|---|---|
| 1471055 | 4/1989 | U.S.S.R. | 432/24 |

*Primary Examiner*—William E. Wayner

*Attorney, Agent, or Firm*—Webb, Burden, Ziesenheim & Webb

[57] ABSTRACT

A method for providing uniform temperature in a furnace, such as a soaking pit or a reheat furnace is disclosed. Temperatures at a front wall and a burner wall within the heating chamber are constantly monitored by a computer, and the computer operates a direct-fired burner, or for example, a pair of regenerative burners, in one of two modes to place heat either at the front wall or the burner wall. The burner is oversized in relation to a maximum firing rate required by the heating chamber design. To heat the front wall, an impulse firing mode is initiated by the computer wherein the burner is fired at its full, overrated capacity for a time proportionally less than a normal firing cycle. To heat the burner wall, the computer initiates a proportional firing mode wherein the burner is fired for the full normal cycle, but at a rate which is equivalent to the actual firing rate demand calculated by the computer. These firing modes may be combined throughout an entire heating campaign to uniformly heat the heating chamber.

13 Claims, 4 Drawing Sheets

METHOD FOR FIRING DIRECT-FIRED BURNER

BACKGROUND OF THE INVENTION

1. Field of the Invention

My invention relates to a method for firing direct-fired burners used in industrial furnaces such as soaking pits and reheat furnaces and, more particularly, to side-fired or end-fired furnaces.

2. Description of the Prior Art

Metallurgical and other heat-treating furnaces require precise control of temperature distributions within the furnaces to maintain product quality and consistency. Normally, burners are located at opposite ends of the furnace, and in the case of soaking pits for heating steel ingots, these burners are initially operated at maximum capacity to bring the ingots up to rolling temperature as fast as possible. The firing rate of the burners is thereafter reduced to maintain the proper temperature while the ingots are being thermally soaked. With burners on each end of the furnace, a relatively uniform distribution of heat throughout the furnace is assured.

However, in certain cases it may not be possible to position burners on both ends of the furnace due to design constraints such as reduced clearance on one end of the furnace. This furnace situation is common to retrofit jobs. The alternative is to mount all of the burners on one side of the furnace, but this presents several problems, which were recognized in U.S. Pat. No. 4,475,885 of which I am an inventor. That patent discloses an adjustable flame burner which permits adjustment of the flame characteristics under various operating conditions. Specifically, the burner may yield a short, high release combustion pattern having a large flame diameter with effectively zero forward velocity. Alternatively, the burner may be adjusted to produce an intense flame approximately three times as long as the previously described flame and having an essentially zero radial component. The burner is adjustable between these two extremes to provide a wide variety of flame characteristics. This burner has proven quite successful in soaking pits and side-fired furnace applications.

To date, it has not been possible to utilize fixed flame burners for totally effective heating of side-fired furnaces. Fixed flame burners simply cannot control temperature distribution due to the presence of furnace conditions such as gas movement throughout the furnace, differing stock sizes and differing production rates. Certain attempts have been made to utilize fixed flame burners in side-fired furnaces wherein rich gaseous fuels are supplied to the burner, and the burner is fired at normal rates. However, the quantity of rich gaseous fuel needed to meet a certain heat demand adds little weight to the air/fuel mix and thus the momentum (mass times velocity) of the flame cannot be varied significantly by altering the air/fuel mix. Momentum generally determines how far a flame will travel, and the low momentum flame will not provide sufficient heat to the end of the furnace opposite the burners. It is undesirable to raise fuel velocity as this tends to promote flame separation.

Other attempts have been made in the art to vary the heat release and flame length of a burner by altering the velocity and mixing arrangements of rich gaseous fuels supplied thereto. These methods are known to achieve a minor variation in flame characteristics. The method of firing described herein provides a much greater variation in flame characteristics. Thus, it is an object of the present invention to provide a method for controlling fixed flame and moderately adjustable flame burners in side-fired furnaces and soaking pits utilizing rich gaseous and liquid fuels. It is a further object to assure uniform temperature distribution throughout side-fired furnaces, thereby maintaining product quality. It is a still further object of the invention to introduce heat to the furnace at a rate which is consistent with the desired properties of the stock being heated.

SUMMARY OF THE INVENTION

Accordingly, I have invented a method for firing conventional and regenerative direct-fired burners to produce a uniform temperature within a heating chamber which has a front wall and a burner wall opposite the front wall. The method is most useful in cases where both of the burners are mounted on the same wall, referred to as the burner wall. In accordance with the method, a control temperature and a trailing temperature are measured within the heating chamber at the front wall and the burner wall, respectively, or vice versa. The measurements are entered into a computer where the difference between the control temperature and the trailing temperature is computed, the control temperature is compared to a pre-programmed set point to determine whether it is greater than, equal to or less than that set point, and the difference between the control temperature and the trailing temperature is compared to a pre-programmed set point $\Delta T$ to determine whether it is greater than, equal to or less than the set point difference. Additionally, a firing rate demand value, F is derived as a function of the deviation of the control temperature from the set point.

Normally, the control temperature will be measured at the front wall. In this case, a high-momentum firing mode, referred to as an impulse firing mode, is initiated by the computer to heat the front wall when the control temperature is less than the set point and the difference is less than the set point $\Delta T$. The burners are fired at their full capacity, C, for a time, $t_f$, defined by the equation $t_f=(F/C)t_c$, where $t_c$ represents the time for a normal firing cycle which includes, in the case of regenerative burners, firing of both burners, one-at-a-time.

The computer initiates a low-momentum firing mode, referred to as a proportional firing mode, to heat the burner wall when the difference between the front wall temperature and the burner wall temperature becomes greater than the set point $\Delta T$. The burners are thereby fired at a rate which equals F for the normal firing cycle, $t_c$.

When the control temperature, normally the front wall temperature, equals the set point and the difference between the control temperature and the trailing temperature, normally the front wall temperature and the burner wall temperature, is less than the set point $\Delta T$, the burners are bottled, i.e., not operated.

The method may include mechanical adjustment of the flames initiated in the impulse firing mode or the proportional firing mode to enhance heating of the front wall or burner wall, respectively.

In accordance with my invention, the burners have a higher firing rate capacity than would normally be needed to meet the heating chamber's pre-determined heat requirement. Thus, the maximum firing rate during the impulse firing mode is appreciably greater than that of the proportional firing mode, so that the method of the present invention does effectively increase heat penetration and flame length with changes in fuel velocity.

Further details and advantages of the present invention will become apparent from the following detailed description and the accompanying drawings.

DETAILED DESCRIPTION OF THE PREFERRED EMBODIMENTS

Figure 1:
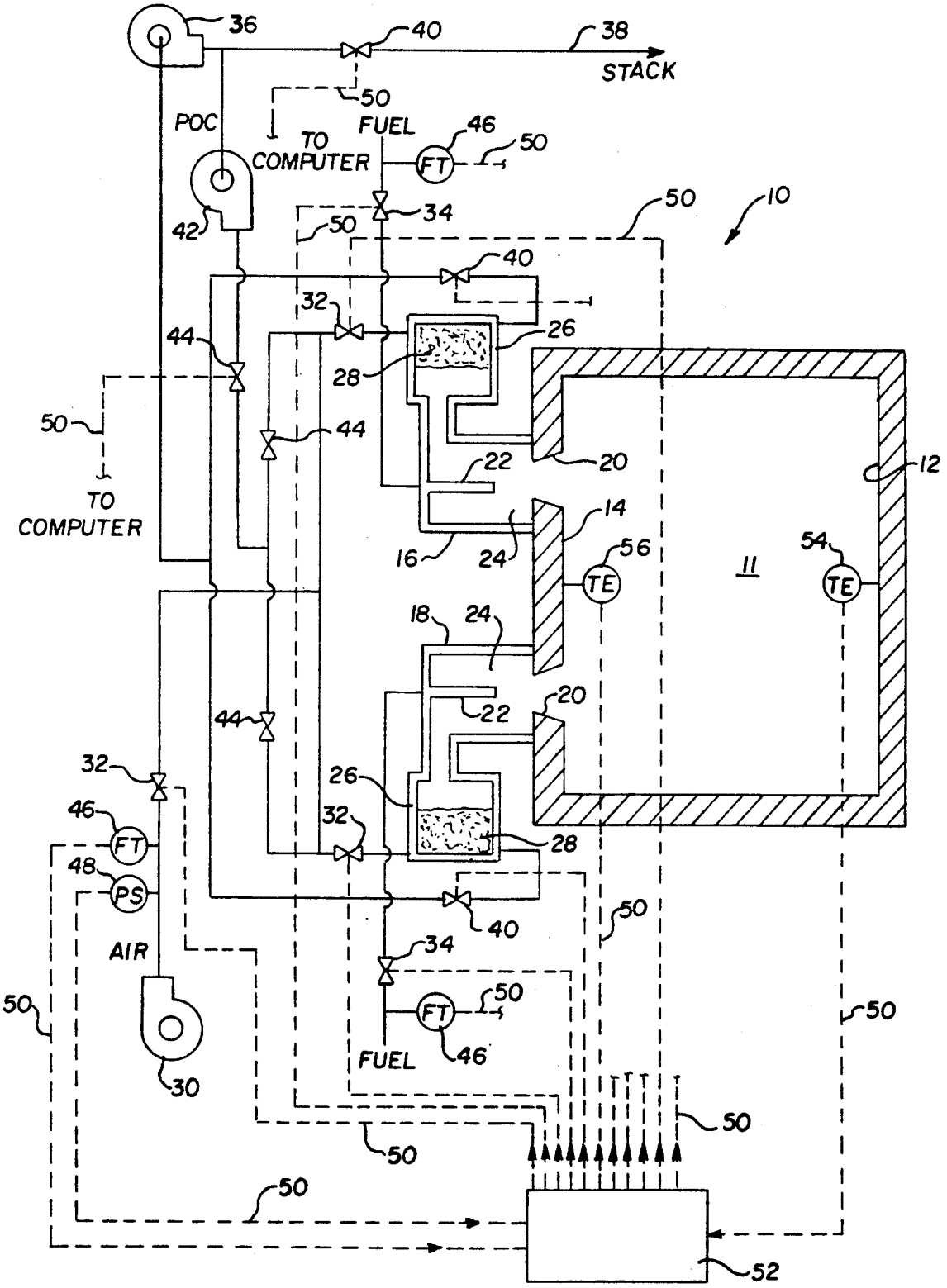
FIG. 1 is a schematic view of a regenerative furnace.

FIG. 1 depicts a furnace 10 in accordance with the present invention. A heating chamber 11 has a front wall 12 with a burner wall 14 opposite the front wall 12. The heating chamber 11 may be a side-fired reheat furnace or a soaking pit with a pair of regenerative burners 16, 18 mounted on one end wall, i.e., burner wall 14. Each burner 16, 18 has a port 20, a fuel line 22 and an air/fuel mixing area 24. Additionally, each burner 16, 18 has a regenerator 26 in fluid communication with the burner, each regenerator being charged with a ceramic media 28 for heat exchange purposes.

The furnace 10 also has means for supplying air and fuel to the burners 16, 18, including a combustion air fan 30, a plurality of air valves 32, a pair of fuel valves 34, along with the appropriate conduits. An exhaust fan 36 is also included for introducing products of combustion to a stack 38. A plurality of exhaust valves 40 control the amount of products of combustion sent to the stack, and some of the products of combustion may be tapped from the exhaust by an exhaust gas recirculation ("EGR") fan 42. Combustion air is thus vitiated with products of combustion via the EGR fan 42 and a plurality of EGR valves 44, thereby reducing the amount of NOx emitted from the burners 16, 18.

Typical regenerative furnaces operate as follows. Air is introduced to the first burner 16 after it is pre-heated by regenerator 26. Fuel is introduced from the fuel line 22, and the resultant flame issues from port 20 into the heating chamber 11. Products of combustion exit the heating chamber through the second burner 18 and are directed to its regenerator 26 where heat is absorbed by the ceramic media 28. Once the ceramic media 28 becomes sufficiently heated, flow through the system is reversed so that air and fuel are now supplied to the second burner 18, and the flame issues from its port 20. The first burner 16 now receives products of combustion from the heating chamber 11, and its regenerator 26 is thereby heated. This normal firing cycle, including ignition, firing of each burner 16, 18 one-at-a-time, and purging of each regenerator 26 between reversals of flow, will last a pre-determined period of time, $t_c$. For example, the system may be designed to include a normal firing cycle, $t_c$ equal to 20 seconds (18 seconds firing and 1.5–2 seconds igniting/purging).

A plurality of flow rate sensors 46 monitor fuel and combustion air flow rates to the burners 16, 18, and a pressure sensor 48 monitors combustion air pressure. The sensors and valves are connected by a plurality of lead lines 50 to a computer 52 so that sensor measurements may be fed back to the computer, and the computer 52 thereby operates the various valves according to pre-programmed control logic well known to those skilled in the art. According to the invention, a first temperature sensor 54 is placed on the front wall 12 and a second temperature sensor 56 is placed on the burner wall 14. Each sensor is connected by a lead line 50 to the computer 52 so that the temperature measurements may be entered into the computer.

Additionally, the burners 16, 18 are oversized in relation to the capacity of heating chamber 11. Specifically, the heating chamber 11 has certain design requirements regarding its heat and fuel demand, depending on the size of the chamber and the nature of the materials to be heated therein. The burners 16, 18 are sized to have a firing capacity rated over this heat and fuel demand requirement.

To determine the degree to which the burners should be oversized, the following factors are considered. Initially, a burner, including the mixing area 24 and the burner port 20, is sized to produce an exit velocity low enough to create a flame momentum which keeps the flame near burner wall 14 so that the burner may be able to overheat the burner wall 14. Next, using the distance from the burner wall 14 to front wall 12, the momentum needed to heat the front wall 12 is determined. Then, taking the burner design established above for the low momentum flame, burner auxiliary equipment, such as fans, flues and ducts are sized to produce a flame having the momentum required to heat the front wall. It is anticipated that in most applications, the burner will have to be oversized by a factor of 1.0–1.5. For example, a conventional burner design requiring a 13 MM Btu/hr maximum firing rate may be oversized to produce a flow rate of 18 MM Btu/hr. The burners should be oversized so that, given the size of the mixing area 4 and port 20 required to overheat the burner wall 14, the front wall 12 can be heated to a greater temperature than the burner wall when firing at the oversized rate.

The present invention utilizes the temperature sensors 54, 56 and the oversized burners 16, 18 to produce a uniform temperature within the heating chamber 11, despite the fact that both burners are mounted on the burner wall 14 of the heating chamber. The measurements taken by the temperature sensors 54, 56 are entered into the computer 52, which is pre-programmed to identify one of the temperatures as a control temperature and the other as a trailing temperature. The computer then performs various functions as follows. First, the difference between the control temperature and the trailing temperature is computed, then the control temperature is compared to a pre-programmed set point to determine whether it is greater than, equal to or less than the set point. Next, the difference between the control temperature and the trailing temperature is compared to a pre-programmed set point $\Delta T$ to determine whether it is greater than, equal to or less than the set point $\Delta T$.

The set point is basically a target temperature for the heating chamber 11 which is based on the characteristics of the particular heating campaign for the furnace. The set point $\Delta T$ basically sets forth the maximum difference in temperature between the front wall and the burner wall which will be tolerated by the heating campaign. The set point and the set point ΔT may be programmed to change over time, or they may be constant, depending upon the nature of the materials being heated in the furnace. Generally, the computer 52 controls the burners 16, 18 and the means for supplying air and fuel to the burners so that the pre-programmed set point is maintained. The invention enhances uniformity of temperature within the heating chamber by constantly monitoring the temperature differential within the heating chamber and taking steps, further discussed below, to keep the temperature differential within the pre-programmed set point ΔT.

Normally, the temperature of the front wall 12 is designated the control temperature while that of the burner wall 14 is designated the trailing temperature. Thus, the front wall temperature will constantly be compared to the set point and the difference between the front wall temperature and the burner wall temperature will be compared to the set point ΔT. It may in some cases be desirable to designate the burner wall as the control temperature, in which case the logic in the computer would be reversed.

The invention contemplates two independent firing modes for the burners 16, 18, one designed to place heat at the front wall 12 in the heating chamber 11, while the other is designed to place heat at the burner wall 14. To heat the front wall 12, the front wall temperature is first measured by temperature sensor 54, and this measurement is entered into the computer 52. The computer then derives a firing rate demand value, F, as a function of the front wall temperature and the pre-programmed set point. Basically, the firing rate demand value, F, represents the rate at which the burners 16, 18 must be fired to generate sufficient heat for the front wall temperature to be raised to meet the set point. The logic and formulation required to derive F is well known to those skilled in the art.

After F is calculated, and assuming it is greater than zero and the difference is less than the set point ΔT, an impulse firing mode is initiated by the computer, essentially by signalling the appropriate valves to fire the first burner 16 at its full capacity, C, for a time, $t_f$, defined by the equation $t_f=(F/C)t_c$. As discussed above, $t_c$ represents the time for a normal firing cycle which includes firing of both burners 16, 18, one-at-a-time. It will be understood that F and C must be expressed in identical units, such as Btu/hr.

Figure 2:
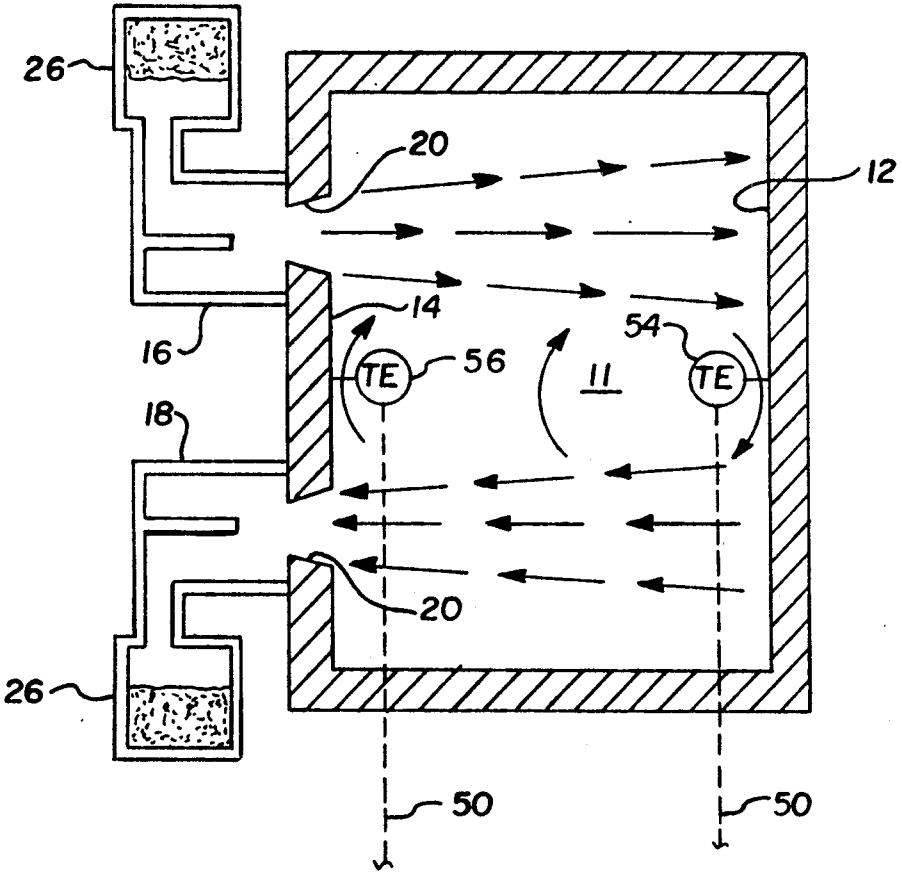
FIG. 2 is a schematic view of the heating chamber and regenerative burners of FIG. 1 in an impulse firing mode.

The impulse firing mode is depicted schematically in FIG. 2. The oversized burners 16, 18, fired at full capacity C, issue a highly intense flame which penetrates the full length of the heating chamber 11 to place heat at the front wall 12. The oversizing of the burners 16, 18 facilitates use of rich gaseous fuels in the air/fuel mix and provides momentum variability. Since these fuels are rich in energy, less fuel is needed and the mass of the air/fuel mix is reduced. Simply raising the fuel velocity on a normal-size burner is undesirable as this tends to promote flame separation. Thus, the oversized burner, fired at its full capacity, will project the heat to the front wall 12 utilizing rich gaseous fuel or liquid fuel without the problem of flame separation.

Figure 3:
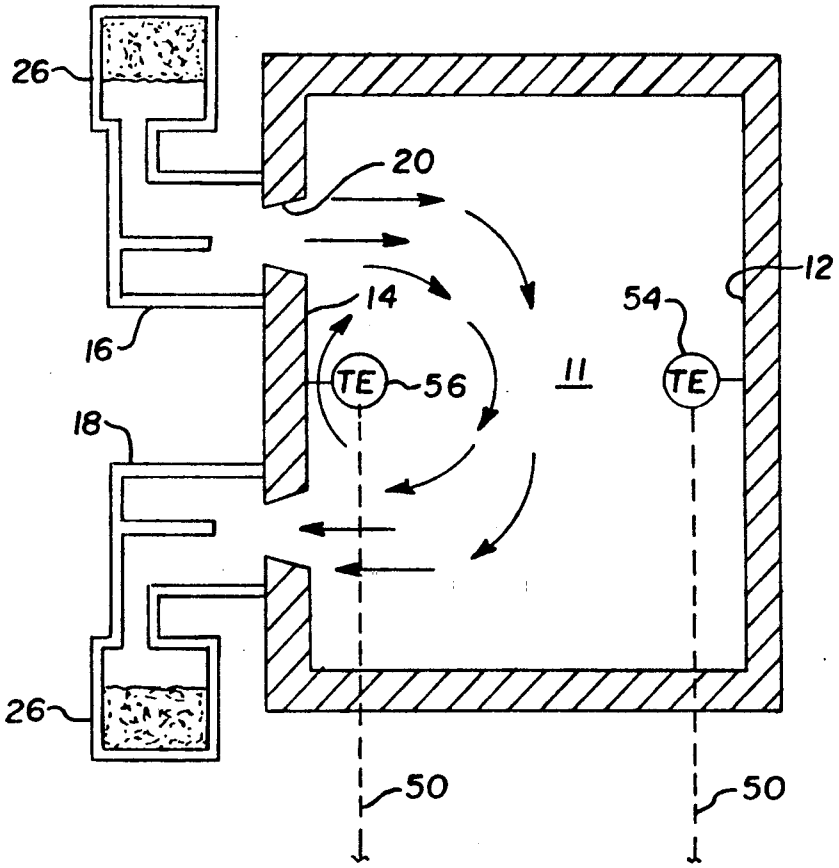
FIG. 3 is a schematic view of the heating chamber and regenerative burners of FIG. 1 in a proportional firing mode.

In order to heat the burner wall 14, a proportional firing mode is initiated by the computer. First, the temperature sensor 56 measures the burner wall temperature and enters that measurement into the computer 52. Again, a firing rate demand value, F, is computed as a function of the burner wall temperature and the set point. When the front wall is designated as the control temperature, the firing rate demand value, F, is calculated to bring the burner wall temperature up to a predetermined temperature within the set point difference, i.e., the tolerated difference between the burner wall and front wall temperatures. However, if the burner wall temperature is designated as the control temperature, then the temperature of the burner wall 14 is directly compared to the set point and the firing rate demand value, F, is calculated accordingly. When the proportional firing mode is initiated, the burners are fired at a rate which equals F for a time equal to $t_c$, so that the burners are fired at the actual firing rate demand for the normal firing cycle. The proportional firing mode is depicted in FIG. 3. With the burners firing at the actual demand rate, the circulation pattern shown in FIG. 3 is developed. Thus, heat is concentrated near the burner wall 14. The lower momentum provided by the rich gaseous or liquid fuel mix and the lower mass flow keeps the flame near the burner wall 14.

These two modes may be combined to provide a continuum of uniform heat production throughout the heating chamber 11 during an entire furnace campaign. The temperatures at the front wall 12 and the burner wall 14 are constantly monitored by the temperature sensors 54, 56 and the computer 52 defines various operating conditions based on the control logic. In a first operating condition, the control temperature is less than the set point. In this case, the computer initiates the impulse firing mode (assuming the front wall is controlling) and the front wall temperature is thereby raised toward the set point.

In a second operating condition, the control temperature is less than or equal to the set point, but the difference between the control temperature and the trailing temperature is greater than the set point ΔT. At this time, the computer initiates the proportional firing mode (assuming the burner wall is the trailing temperature) and the burner wall is thereby heated until its temperature is raised to within the set point ΔT. In the final operating condition, the control temperature equals the set point and the difference between the control temperature and the trailing temperature is less than the set point ΔT. At this time, the burners are "bottled", i.e., they are not operated. The burners remain bottled until the first or second operating condition is again defined by the computer 52.

The method may also include mechanical adjustment of the flames issuing from burners 16, 18 to further enhance heating of the front wall and burner wall during the impulse mode and proportional mode, respectively. For example, in the proportional firing mode, the heat release pattern can be further shortened by injecting the fuel at a divergent angle through multiple spray holes. Alternatively, gaseous fuel may be swirled to intimately mix the fuel with combustion air, producing a shorter, low-momentum flame near the burner wall. Thus, the method is most useful with adjustable flame burners having inadequate adjustable heat release capabilities to provide the uniformity of temperature which the present method ensures. Mechanical flame adjustment is further discussed in my previous U.S. Pat. No. 4,475,885 and other patents cited therein.

Figure 4A:
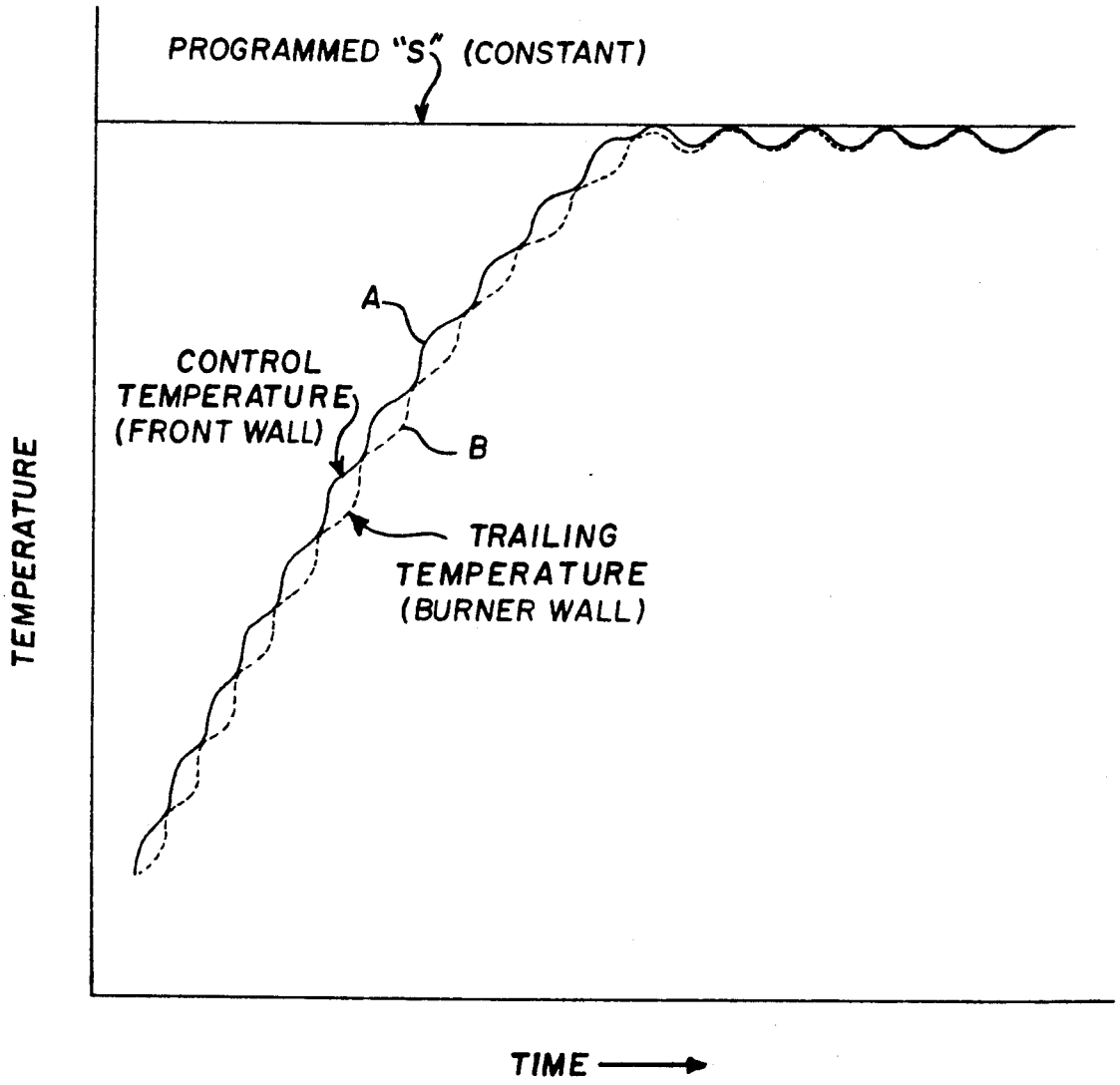
FIGS. 4A and 4B are graphic representations of a set point, a control temperature and a trailing temperature over time throughout a heating campaign in accordance with the present invention.
Figure 4B:
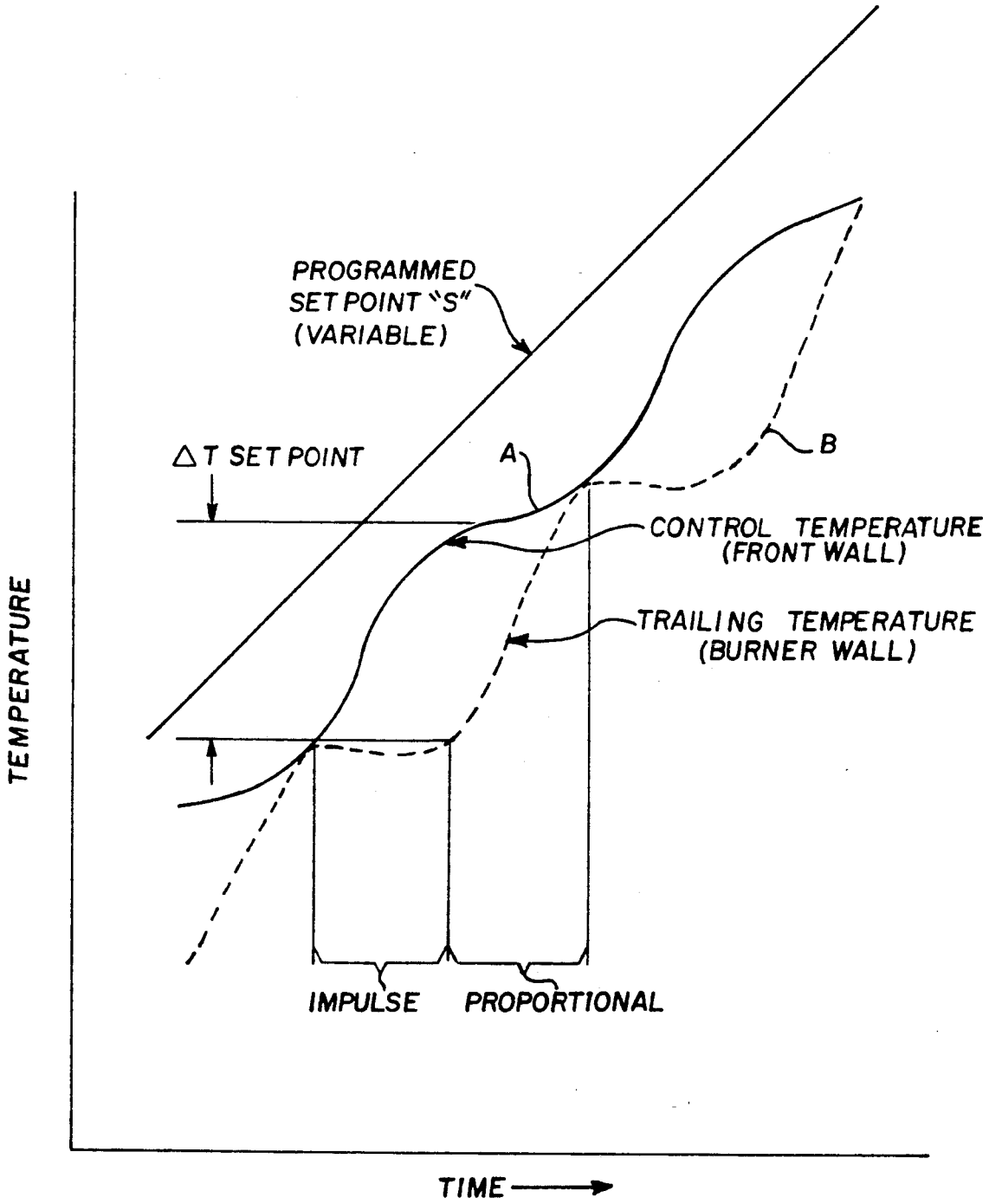

FIGS. 4A and 4B graphically depict the control temperature and the trailing temperature over time throughout a heating campaign operated in accordance with the present invention. The control temperature in this campaign is measured at the front wall while the trailing temperature is measured at the burner wall. A control temperature curve A shows the progression of the front wall temperature toward the set point, S, and a trailing temperature curve B shows the fluctuation of the burner wall temperature during the impulse firing mode and the proportional firing mode. This behavior is more clearly shown in the blow-up portion of FIG. 4B wherein the burner wall temperature increases during the proportional firing mode and then falls back during the impulse firing mode, until the front wall-burner wall temperature differential exceeds the set point ΔT, at which time the proportional firing mode is re-initiated.

EXAMPLE

Assume that a soaking pit design requires a maximum heat demand of 13 million Btu's per hour, considering the heat provided by exhaust gas recirculation and preheated combustion air. A conventional design would call for burners having a 13 million Btu per hour capacity. However, the present invention includes burners and auxiliary equipment which would be rated to provide an instantaneous firing rate of 18 million Btu's per hour, considering heating chamber dimensions and other factors discussed above. The normal firing cycle, $t_c$, would equal 20 seconds (18 seconds firing, 1.5–2 seconds purging and igniting).

When the computer defines the operating conditions for the impulse firing mode, the burners are fired at their full capacity, 18 million Btu's per hour, for a firing time directly proportional to the actual firing rate calculated by the computer. For example, if the actual firing rate "F" were 12 million Btu's per hour, the burners would be fired at their maximum rate "C" of 18 million Btu's per hour, for a time, $t_f$ equal to $(F/C)t_c$ or 12/18 times 18 seconds, or 12 seconds. At lower demands, the firing time would be proportionally less, but the cycle would still be divided into 20 second increments (18 seconds or less firing, balance bottled, purging or igniting).

When the burner wall temperature is outside the set point ΔT, the burners operate in the proportional firing mode for the full 20 second cycle at the actual firing rate calculated by the computer. The lower firing rate and lower momentum levels enable the soaking pit to be heated at the burner wall. At lower demands, the burner would fire at still lower rates, but always for the full 20 second cycle.

Having described the presently preferred embodiments of the invention, it will be understood that it is not intended to limit the invention except within the scope of the following claims. Particularly, while the preferred embodiment has been described in conjunction with regenerative burners, it will be understood that the method is equally applicable to all direct-fired burners, such as recuperative burners and other non-regenerative burners.

I CLAIM:

1. A method for firing a direct-fired burner to heat a front wall in a heating chamber, said burner having a firing capacity, C, greater than a maximum firing rate required for said heating chamber, said burners mounted on a burner wall opposite said front wall, said method comprising the steps of:

(a) measuring a front wall temperature;

(b) entering the measurement of step (a) into a computer;

(c) deriving a firing rate demand value, F, by means of said computer as a function of said front wall temperature and a set point greater than said front wall temperature; and (d) initiating an impulse firing mode by means of said computer wherein said burner is fired at its full capacity, C, for a time, $t_f$, defined by the equation $t_f=(F/C)t_c$, where $t_c$ represents the time for a normal firing cycle which includes ignition and firing.

2. The method of claim 1 including mechanically adjusting the flame initiated in step (d) to enhance heating of said front wall.

3. The method of claim 1 wherein step (d) includes firing a pair of regenerative burners for said time, $t_f=(F/C)t_c$, where $t_c$ represents the time for a normal firing cycle which includes, ignition, firing of both burners one-at-a-time and purging.

4. A method for firing a direct-fired burner to produce a uniform temperature within a heating chamber, said heating chamber having a front wall and a burner wall opposite said front wall, said burner mounted on said burner wall, said burner having a firing capacity, C, greater than a maximum firing rate required for the heating chamber, said method comprising the steps of:

(a) measuring a control temperature and a trailing temperature at said front wall and said burner wall, respectively;

(b) entering the measurements of step (a) into a computer wherein a difference between said control temperature and said trailing temperature is computed, said control temperature is compared to a pre-programmed set point to determine whether said control temperature is greater than, equal to or less than said set point, and said difference is compared to a pre-programmed set point ΔT to determine whether said difference is greater than, equal to or less than said set point ΔT;

(c) deriving a firing rate demand value, F, by means of said computer as a function of said control temperature and said set point;

(d) initiating an impulse firing mode by means of said computer when said control temperature is less than said set point and said difference is less than said set point ΔT, wherein said burner is fired at its full capacity, C, for a time, $t_f$, defined by the equation $t_f=(F/C)t_c$, where $t_c$ represents the time for a normal firing cycle which includes ignition and firing of said burner;

(e) initiating a proportional firing mode by means of said computer when said difference is greater than said set point ΔT, wherein said burner is fired at a rate which equals F for the normal firing cycle, $t_c$; and (f) bottling said burner when said control temperature equals said set point and said difference is less than said set point ΔT.

5. The method of claim 4 wherein the control temperature and the trailing temperature are measured at the burner wall and the front wall, respectively.

6. The method of claim 5 wherein the impulse firing mode is initiated when the difference between the control temperature and the trailing temperature is greater than the set point ΔT.

7. The method of claim 5 wherein the proportional firing mode is initiated when the control temperature is less than the set point and the difference between the control temperature and the trailing temperature is less than the set point ΔT.

8. The method of claim 4 including the further step of mechanically adjusting the flame initiated in step (d)

and step (e) to enhance heating of the front wall and the burner wall, respectively.

9. A method for firing a pair of regenerative burners to produce a uniform temperature within a heating chamber, said heating chamber having a front wall and a burner wall opposite said front wall, both of said burners mounted on said burner wall, said burners having a firing capacity, C, greater than a maximum firing rate required for the heating chamber, said method comprising the steps of:

(a) measuring a control temperature and a trailing temperature at said front wall and said burner wall, respectively;

(b) entering the measurements of step (a) into a computer wherein a difference between said control temperature and said trailing temperature is computed, said control temperature is compared to a pre-programmed set point to determine whether said control temperature is greater than, equal to or less than said set point, and said difference is compared to a pre-programmed set point $\Delta T$ to determine whether said difference is greater than, equal to or less than said set point $\Delta T$;

(c) deriving a firing rate demand value, F, by means of said computer as a function of said control temperature and said set point;

(d) initiating an impulse firing mode by means of said computer when said control temperature is less than said set point and said difference is less than said set point $\Delta T$, wherein said burners are fired at their full capacity, C, for a time, $t_f$, defined by the equation $t_f=(F/C)t_c$, where $t_c$ represents the time for a normal firing cycle which includes firing of both burners one-at-a-time;

(e) initiating a proportional firing mode by means of said computer when said difference is greater than said set point $\Delta T$, wherein said burners are fired at a rate which equals F for the normal firing cycle, $t_c$; and (f) bottling said burners when said control temperature equals said set point and said difference is less than said set point $\Delta T$.

10. The method of claim 9 wherein the control temperature and the trailing temperature are measured at the burner wall and the front wall, respectively.

11. The method of claim 10 wherein the impulse firing mode is initiated when the difference between the control temperature and the trailing temperature is greater than the set point $\Delta T$.

12. The method of claim 10 wherein the proportional firing mode is initiated when the control temperature is less than the set point and the difference between the control temperature and the trailing temperature is less than the set point $\Delta T$.

13. The method of claim 9 including the further step of mechanically adjusting the flame initiated in step (d) and step (e) to enhance heating of the front wall and the burner wall, respectively.

* * * * *